United States Patent [19]

Robinson

[11] 4,099,723

[45] Jul. 11, 1978

[54] MULTI-TIER GAME BOARD

[76] Inventor: Pablo T. Robinson, 4002 N. 59th Dr., Phoenix, Ariz. 85033

[21] Appl. No.: 766,083

[22] Filed: Feb. 7, 1977

[51] Int. Cl.[2] ..... A63F 3/02

[52] U.S. Cl. ..... 273/241; 273/284; 273/285

[58] Field of Search ..... 273/131 AC, 131 AD, 273/131 B, 130 AC, 130 A, 136 GB

[56] References Cited

U.S. PATENT DOCUMENTS

| | | | |
|---|---|---|---|
| D. 210,542 | 3/1968 | Stookey | 273/131 AC |
| D. 215,103 | 9/1969 | Stevens et al. | 273/131 AC |
| 3,406,975 | 10/1968 | Berger | 273/136 GB |
| 3,767,201 | 10/1973 | Harper et al. | 273/131 AC |

FOREIGN PATENT DOCUMENTS

| | | | |
|---|---|---|---|
| 2,237,418 | 3/1975 | France | 273/134 G |

*Primary Examiner*—Richard C. Pinkham
*Assistant Examiner*—Harry G. Strappello
*Attorney, Agent, or Firm*—Herbert E. Haynes, Jr.

[57] ABSTRACT

A multi-tier game board upon which games such as chess and checkers may be played with the usual playing pieces and under the usual rules. The game board includes a first tier of square ring configuration having 28 playing squares, a second tier of square ring configuration having 20 playing squares, a third tier of square ring configuration having 12 playing squares and a fourth tier of square planar configuration having 4 playing squares. The four tiers may be nestingly positioned with respect to each other to provide a conventional 64 square playing board or may be vertically displaced and vertically aligned with respect to each other to provide a three dimensional game board.

8 Claims, 8 Drawing Figures

MULTI-TIER GAME BOARD

BACKGROUND OF THE INVENTION

1. Field of the Invention

This invention relates to game boards and more particularly to a novel multi-tier game board for three dimensional chess and checker games.

2. Description of the Prior Art

Two dimensional game boards having 64 squares of two alternating colors, which are sometimes referred to as checkerboards and/or chessboards, are well known in the art and have long been employed for the playing of games such as checkers and chess. Such games, particularly the ancient game of chess has maintained its popularity down through the ages apparently due to the rather stimulating mental challenge presented by that game. In the game of chess, there are a number of different classes of pieces, i.e., kings, queens, bishops, knights, rooks, and pawns. The manner in which each of these classes of pieces may be moved on the game board is defined by the rules of the game so as to be different from the permitted movement of other classes. It is this difference in the manner in which the various pieces may be moved which renders the game of chess relatively complex, and no doubt adds to the game's popularity by making the game a rather stimulating mental exercise.

Although the game of checkers does not have the variety of playing pieces and the different moves of chess, it too presents a mentally stimulating game, to a lesser degree, due to its particular rules.

Therefore, since the apparent reason for the success and popularity of the games of chess and checkers appears to be the challenge to the minds of the players, similar games heretofore have been devised by which these games may be played in three dimensions. The rationale behind these three dimensional games was that if a two dimensional game is found mentally stimulating, a three dimensional game would be even more intellectually stimulating and consequently more enjoyable. Typically, however, these prior art three dimensional games have deviated from the traditional games by either adding more playing pieces, more squares to the playing area, drastically changing the playing rules, or even adding more players. As a result of these deviations, a certain amount of the historical charm of these games was naturally lost.

SUMMARY OF THE INVENTION

The present invention provides a novel three dimensional game board having 64 playing squares of two alternating colors displayed thereon, and upon which games such as checkers and chess may be played with the usual playing pieces and under the usual playing rules. The game board is a multi-tier structure including a first tier of square ring configuration having 28 playing squares thereon, a second tier of square ring configuration having 20 playing squares thereon, a third tier of square ring configuration having 12 playing squares thereon, and a fourth tier of square planar configuration having 4 playing squares thereon. The four tiers may be disposed so as to be nestingly positioned with respect to each other in a single flat plane to provide a conventional two dimensional game board, or the tiers may be vertically displaced and vertically aligned with respect to each other to provide a three dimensional game board.

Accordingly, it is an object of the present invention to provide a new and novel game board.

Another object of the present invention is to provide a new and novel three dimensional game board of the type displaying 64 playing squares of two alternating colors, and upon which games such as chess and checkers may be played in the usual manner.

Another object of the present invention is to provide a new and novel game board which is of multi-tier construction with the several tiers thereof being configured so that they may be nestingly arranged to provide a conventional two dimensional game board, or the tiers may be vertically displaced with respect to each other to provide a novel three dimensional game board.

The foregoing and other objects of the present invention, as well as the invention itself, may be more fully understood from the following description when read in conjunction with the accompanying drawings.

DESCRIPTION OF THE PREFERRED EMBODIMENT

Figure 1:
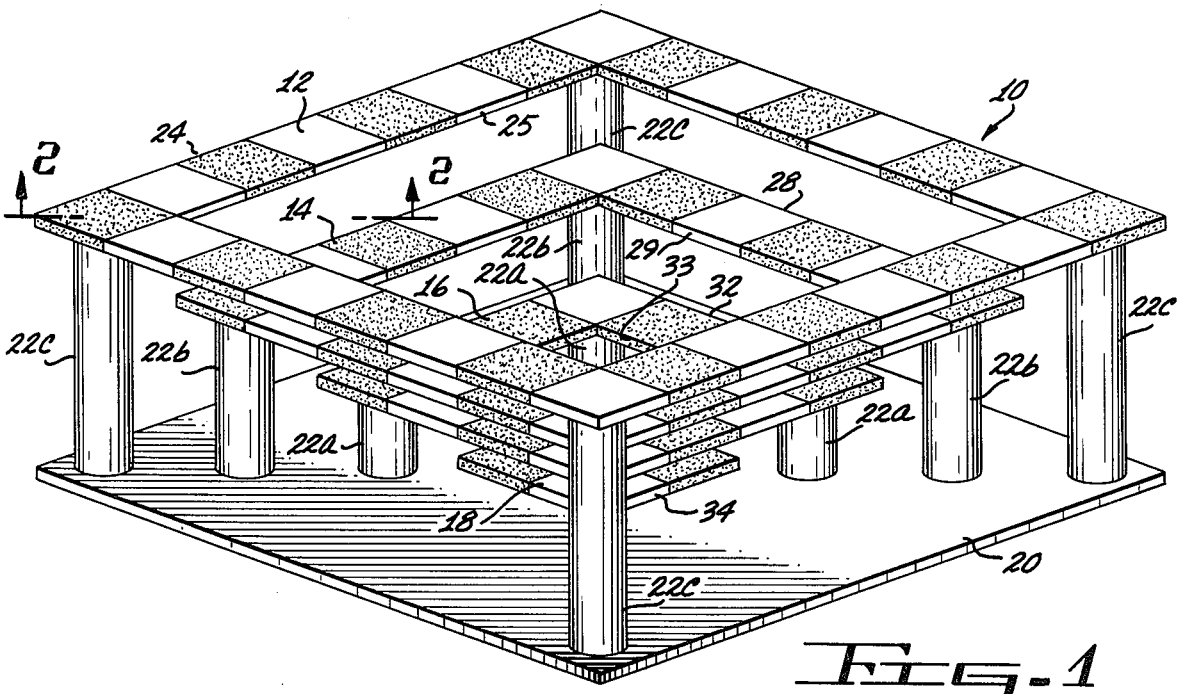
FIG. 1 is an axonometric drawing illustrating the various features of the game board of the present invention.

Referring to the drawings in more detail, FIG. 1 shows the preferred form of the game board of the present invention which is indicated generally by the reference numeral 10. As will hereinafter be described in detail, the game board 10 includes a first tier 12, a second tier 14, a third tier 16, and fourth tier 18, with those tiers being supported in vertically displaced relationships above a base 20 by support means which are illustrated as upstanding columns **22*a*, 22*b*, 22*c***, or pedestals, of various lengths.

As will become apparent as this description progresses, the game board 10, although differing in appearance and structure, is similar to a conventional checkerboard or chessboard. As is well known, such game boards are provided with 64 playing squares arranged in a checkered pattern of alternating colors, with the colors most often employed being black and white for chess and black and red for checkers.

In the interest of clarity and brevity, a well known standard of system of notation has been adopted for giving a particular designation to each of the playing squares of a chessboard.

Briefly, the standard system of notation is accomplished by calling the horizontal rows of squares "ranks", and numbering them according to their distance from each player's near side. Thus, the near player's first rank is the same as the opposite player's eighth rank so that each rank has two numbers applied thereto. The squares running up and down the board are called "files" and are named for the chess piece which originally occupies the first rank of that file at the beginning of the game. The chess pieces to the right of the king are known as the king's bishop, the king's knight, and the king's rook. Those pieces to the left of the queen are known as the queen's bishop, the queen's knight, and the queen's rook. Due to the original placement of the king and queen, the names of the files are the same for both players. With such a system, it is seen that each of the sixty-four playing squares is precisely designated. As a further part of the standard system of notation, the following abbreviations have been adopted:

| | | | |
|---|---|---|---|
| K | King | Q | Queen |
| KB | King's Bishop | QB | Queen's Bishop |
| KK | King's Knight | QK | Queen's Knight |
| KR | King's Rook | QR | Queen's Rook |

Reference is now made to FIGS. 5–8 wherein the playing squares provided on the individual tiers 12, 14, 16, and 18 of the game board 10 are identified with the designations of the above described standard system of notation.

Figure 5:
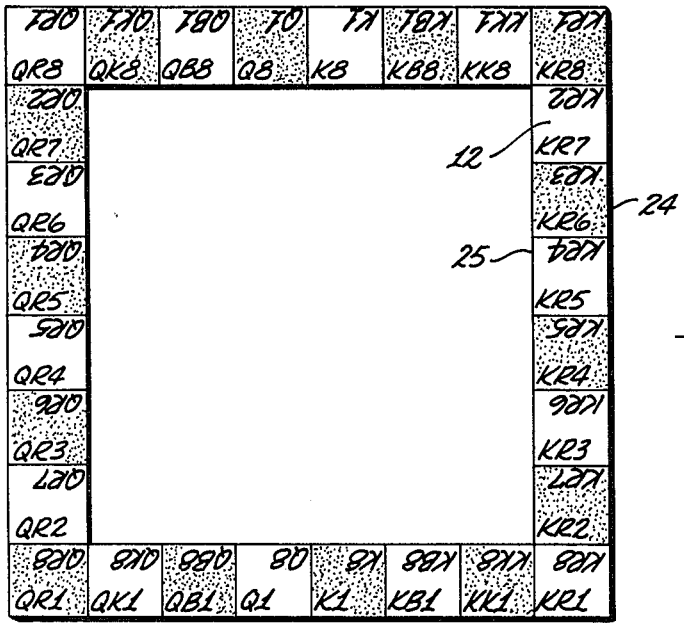
FIG. 5 is a plan view of the first tier of the game board of the present invention.

As shown in FIG. 5, the first tier 12 of the game board 10 is a planar surface of square ring configuration having an outer peripheral edge 24 and an inner peripheral edge 25, both of which are endless. Each leg which forms the first tier 12 has a width dimension which is substantially equal to the length of one of the sides of each of the playing squares. There are a total of 28 playing squares displayed on the first tier, and in accordance with the standard system of notation, those squares are identified as the entire first and eighth rank (as read from either direction), and the entire King's Rook (KR) file and the entire Queen's Rook (QR) file. Another way of stating the same thing is that the first tier 12 includes the squares QR1, QK1, QB1, Q1, K1, KB1, KK1, and KR1 as forming the entire first rank, and QR8, QK8, QB8, Q8, K8, KB8, KK8, and KR8 as forming the entire eighth rank. The Queen's Rook file includes the squares QR1, QR2, QR3, QR4, QR5, QR6, QR7, and QR8, and the King's Rook file includes squares identified as KR1, KR2, KR3, KR4, KR5, KR6, KR7, and KR8.

Figure 6:
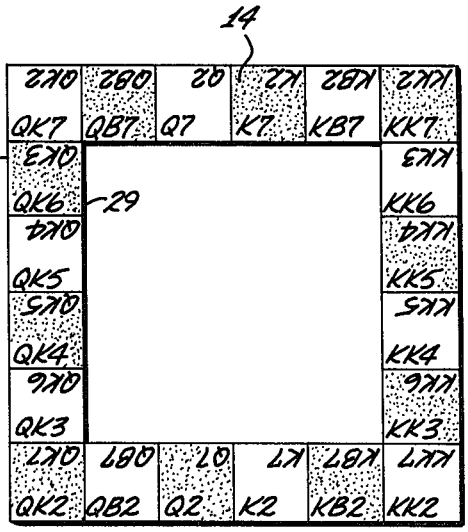
FIG. 6 is a plan view of the second tier of the game board of the present invention.

FIG. 6 illustrates the second tier 14 of the game playing board 10 as being a planar surface of square ring configuration, similar to the first tier 12, and having an endless outer peripheral edge 28 and an endless inner peripheral edge 29. Each leg which forms the second tier 14 has a width dimension which is substantially equal to the length of one of the sides of each of the playing squares. There are a total of 20 playing squares displayed on the second tier 14, and in accordance with the standard system of notation, those squares are identified as portions of the second and seventh ranks (as read from either side) which includes squares QK2, 7 through KK2, 7, a portion of the Queen's Knight file including squares QK2, through QK7, and a portion of the King's Knight file including squares KK2 through KK7. In other words, the second tier 14 includes the squares QK2, QB2, Q2, K2, KB2, and KK2 as forming a portion of the second rank, the squares QK7, QB7, Q7, K7, KB7, and KK7, forming a portion of the seventh rank, with the squares QK2, QK3, QK4, QK5, QK6, and QK7 forming a portion of the Queen's Knight file, and the squares KK2, KK3, KK4, KK5, KK6, and KK7 forming a portion of the King's Knight file.

Figure 7:
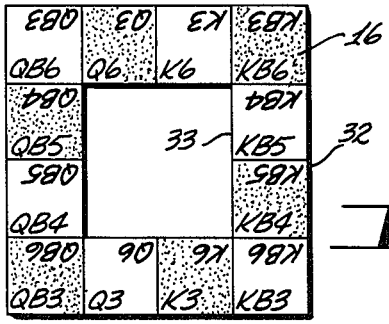
FIG. 7 is a plan view of the third tier of the game board of the present invention.

FIG. 7 illustrates the third tier 16 of the game board 10 as being a planar surface of square ring configuration, similar to the previously described tiers 12 and 14, and having an endless outer peripheral edge 32 and an inner endless peripheral edge 33. Each leg which forms the third tier 16 has a width dimension which is substantially equal to the length of one of the sides of each of the playing squares. There are a total of 12 playing squares displayed on the third tier 16, and in accordance with the standard system of notation, those squares are identified as portions of the third and sixth ranks (as read from either direction) with those portions including the squares QB3, 6 through KB3, 6, a portion of the Queen's Bishop file including squares QB3 through QB6, and a portion of the King's Bishop file including squares KB3 through KB6. In other words, the third tier 16 includes the squares QB3, Q3, K3, and KB3 which forms a portion of the third rank, the squares QB6, Q6, K6, and KB6 which form a portion of the sixth rank, the squares QB3, QB4, QB5, and QB6 which form a portion of the Queen's Bishop file, and the squares KB3, KB4, KB5, and KB6 which form a portion of the King's Bishop file.

Figure 8:
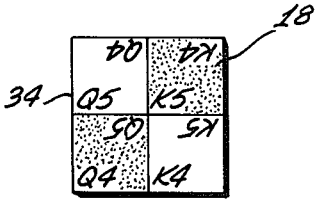
FIG. 8 is a plan view of the fourth tier of the game board of the present invention.

FIG. 8 illustrates the fourth tier 18 of the game board 10 as being a square planar structure having an endless outer peripheral edge 34. There are a total of four playing squares displayed on the fourth tier 18, and in accordance with the standard system of notation, those squares are identified as Q4, Q5, K4, and K5.

As shown in FIGS. 5 and 6, the outside peripheral edge 28 of the second tier 14 is the same size and configuration as the inside peripheral edge 25 of the tirst tier 12, thus, the second tier is nestibly positionable (not shown) within the first tier. Likewise, the outside edge 32 of the third tier 16 is sized and configured to match the inside edge 29 of the second tier 14, to permit nestible positioning (not shown) of the third tier 16 within the second tier 14. Also, the outside edge 34 of the fourth tier 18 matches the inside edge 33 of the third tier 16, thus, permitting nestible positioning (not shown) of the fourth tier 18 within the third tier 16.

It will now be appreciated that if the nestible positioning of the various tiers 12, 14, 16, and 18 as described above is accomplished, those tiers would cooperate to form a conventional two dimension game board (not shown), which would display the usual 64 playing squares in the conventional manner.

It will now be seen that the previously mentioned vertically displaced relationships of the tiers 12, 14, 16, and 18 is made possible by the special configuration of those tiers, and that such vertical displacement will not alter the number or arrangement of the playing squares except to place them in three dimensions rather than two.

Figure 2:
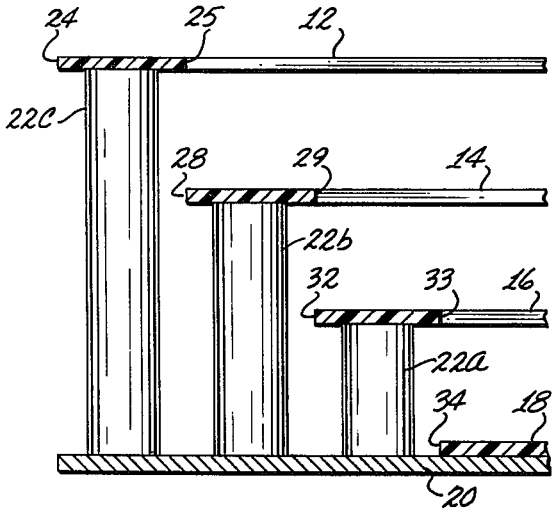
FIG. 2 is an enlarged fragmentary sectional view taken on the line 2—2 of FIG. 1.

As shown in FIGS. 1 and 2, the fourth tier 18 is positioned to lie flat on the upper surface of the base 20 with the third tier 16 spaced above the fourth tier and disposed so that the inner edge 33 of the third tier is in vertical alignment with the outer edge 34 of the fourth tier. The third tier 16 is supported in that position by four columns **22*a* (three shown in FIG. 1**), with a different one of those columns being located at each of the corners of the third tier.

The second tier 14 is similarly spaced above the third tier 16 so that the inner edge 29 of the second tier 14 is in vertical alignment with the outer edge 32 of the third tier, and the second tier is supported by four columns **22*b* (three shown in FIG. 1**) which are located at the corners of the second tier.

Likewise, the first tier 12 is spaced about the second tier 14 so that the endless inner edge 25 of the first tier is in vertical alignment with the endless outer edge 28 of the second tier. The first tier 12 is supported in that vertically displaced position by four columns **22*c* (four shown in FIG. 1**) which are located at the corners of the first tier.

The particular three dimensional arrangement of the game board 10 which is seen best in FIG. 1 may be altered as desired by simply changing the vertically displaced relationships of the tiers 12, 14, 16, and 18. For example, the game board 10 may be arranged into what may be described as a pyramid configuration (not shown) by placing the first tier 12 on the base 20, spacing the second tier 14 immediately above the first tier, placing the third tier 16 above the second tier, and placing the fourth tier above the third tier.

Figure 3:
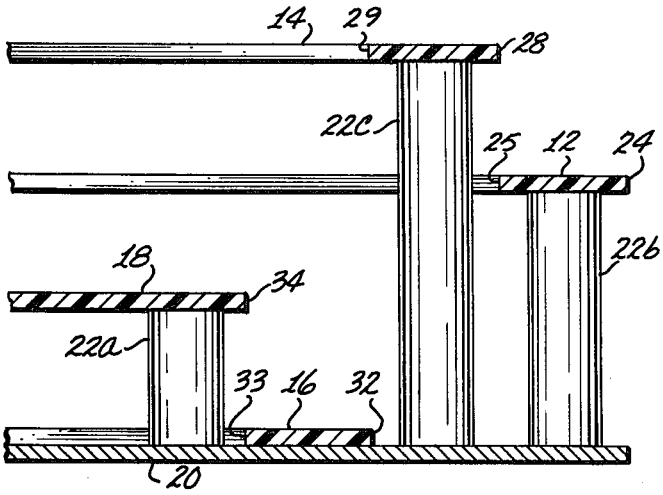
FIG. 3 is a view similar to FIG. 2 and illustrating an alternate arrangement of the game board of the present invention.

A particular alternate arrangement of the game board 10 is shown in FIG. 3, wherein the third tier 16 is placed on the base 20, and the fourth tier 18 is spaced above the third tier 16 and supported in that position by the columns **22*a* (one shown). The first tier 12 is spaced above the fourth tier 18 and is supported in that position by the columns 22*b* (one shown), and the second tier 14 is positioned above the first tier 12 and is supported on the columns 22*c*** (one shown).

Figure 4:
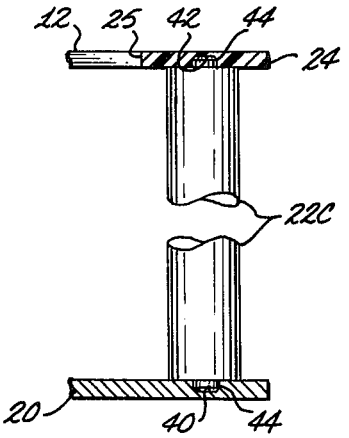
FIG. 4 is an enlarged fragmentary view of a portion of the game board of the present invention which illustrates an example of one technique which may be employed to assemble the various elements thereof.

In any event, the vertically displaced relationships of the multiple tiers 12, 14, 16, and 18 may be achieved by simply placing one of those tiers on the base 20 and positioning the remaining tiers atop the columns **22*a*, 22*b*, and 22*c*, and relying on gravity to maintain such positioning. However, in the interests of more reliable stability and the ease of arriving at a desired three dimensional position, it is preferred that some form of precise locating means and positioning maintaining means be employed. One method of accomplishing such objectives is shown in FIG. 4 wherein a fragmentary portion of the first tier 12, the base 20 and one of the columns 22*c* are shown, with it being understood that this illustration is typical of all of the tiers and the columns. As shown, the base 20 is provided with an aperture 40 formed therein and the tier 12 is provided with a similar aperture 42. The column 22*c* has a pair of bosses 44** formed integrally therewith, and each extending axially from a different one of the opposite end of that column.

With the base 20 being formed with a plurality of apertures 40 (one shown) positioned in appropriate arrays, and the tiers 12, 14, 16, and 18 each being provided with an aperture 42 (one shown) in each of the corners thereof, it will be seen that precision locating of the columns and the tiers relative to the base and to each other may be quickly and easily achieved, and that such mounting when accomplished in accordance with this preferred mounting technique will provide a relatively stable assembly.

It is preferred that the above described positioning and interconnecting technique be employed for the obvious advantages in assembly and stability. Further, that technique allows the game board 10 to be easily disassembled for convenience in packaging, shipping, and storage, and also allows the vertically displaced arrangement to be varied as hereinbefore described.

Should it be desired that a particular three dimensional configuration of the game board 10 be made into a permanent structure, such can be accomplished by simply using a suitable adhesive to affix the columns, base, and tiers into that particular configuration.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A variably configurable multi-tier game board for chess and checker games comprising:

(a) a first tier having a planar surface of square ring configuration upon which 28 playing squares and displayed, said first tier having an endless inner edge;

(b) a second tier vertically displaced from said first tier and having a planar surface of square ring configuration upon which 20 playing squares are displayed, said second tier having an endless outer edge which substantially matches and is in vertical alignment with the inner edge of said first tier, said second tier having an endless inner edge;

(c) a third tier vertically displaced from said second tier and having a planar surface of square ring configuration upon which 12 playing squares are displayed, said third tier having an endless outer edge which substantially matches and is in vertical alignment with the inner edge of said second tier, said third tier having an endless inner edge;

(d) a fourth tier vertically displaced from said third tier and having a planar surface of square configuration upon which four playing squares are displayed, said fourth tier having an endless outer edge which substantially matches and is in vertical alignment with the inner edge of said third tier; and (e) each of said first, second, third, and fourth tiers being a separate entity to allow vertical rearrangement and spacing alterations therebetween.

2. A multi-tier game board as claimed in claim 1 wherein the 28 playing squares displayed on said first tier are identified in accordance with the chess standard system of notation as including:

(a) the entire first rank of playing squares extending along the length of one leg of said first tier;

(b) the entire eight rank of playing squares extending along the length of another leg of said first tier;

(c) the entire King's Rook file of playing squares extending along the length of another leg of said first tier; and (d) the entire Queen's Rook file of playing squares extending along the length of another leg of said first tier.

3. A multi-tier game board as claimed in claim 1 wherein the 20 playing squares displayed on said second tier are identified in accordance with the chess standard system of notation as including:

(a) a portion of the second rank of playing squares extending along the length of one leg of said second tier with that portion including playing squares QK2 through KK2;

(b) a portion of the seventh rank of playing squares extending along the length of another leg of said second tier with that portion including playing squares QK7 through KK7;

(c) a portion of the Queen's Knight file playing squares extending along the length of another leg of said second tier with that portion including the playing squares QK2 through QK7; and (d) a portion of the King's Knight file playing squares extending along the length of another leg of said second tier with that portion including the playing squares KK2 through KK7.

4. A multi-tier game board as claimed in claim 1 wherein the 12 playing squares displayed on said third tier are identified in accordance with the chess standard system of notation as including:

(a) a portion of the third rank of playing squares extending along the length of one leg of said third tier with that portion including the playing squares QB3 through KB3;

(b) a portion of the sixth rank of playing squares extending along the length of another one of the legs of said third tier with that portion including the playing squares QB6 through KB6;

(c) a portion of the Queen's Bishop file playing squares extending along the length of another one of the legs of said third tier with that portion including the playing squares QB3 through QB6; and (d) a portion of the King's Bishop file playing squares extending along the length of another one of the legs of said third tier with that portion including the playing squares KB3 through KB7.

5. A multi-tier game board as claimed in claim 1 wherein the four playing squares displayed on said fourth tier are identified in accordance with the chess standard system of notation as Q4, Q5, K4 and K5.

6. A multi-tier game board as claimed in claim 1 and further comprising:

(a) a base for supporting a selected one of said first, said second, said third and said fourth tiers; and (b) means on said base and upstanding therefrom for supporting the remaining ones of said first, said second, said third and said fourth tiers in vertically displaced and vertically aligned relationships above said base.

7. A multi-tier game board as claimed in claim 6 wherein said means includes a plurality of columns.

8. A multi-tier game board as claimed in claim 1 and further comprising:

(a) a base for supporting said fourth tier in a predetermined location thereon; and (b) support means arranged on said base in a predetermined array and upstanding therefrom for supporting said third tier above said fourth tier and in vertical alignment therewith, for supporting said second tier above said third tier and in vertical alignment therewith, and for supporting said first tier above said second tier and in vertical alignment therewith.

* * * * *